US009719408B2

(12) United States Patent
Gonze et al.

(10) Patent No.: US 9,719,408 B2
(45) Date of Patent: Aug. 1, 2017

(54) SYSTEM AND METHOD FOR ENGINE BLOCK COOLING

(71) Applicant: GM Global Technology Operations LLC, Detroit, MI (US)

(72) Inventors: Eugene V. Gonze, Pinckney, MI (US); Yue-Ming Chen, Canton, MI (US); Vijay Ramappan, Novi, MI (US); Ben W. Moscherosch, Waterford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 287 days.

(21) Appl. No.: 14/505,745

(22) Filed: Oct. 3, 2014

(65) Prior Publication Data

US 2016/0053665 A1 Feb. 25, 2016

Related U.S. Application Data

(60) Provisional application No. 62/040,602, filed on Aug. 22, 2014.

(51) Int. Cl.
*F01P 7/00* (2006.01)
*F01P 7/16* (2006.01)

(52) U.S. Cl.
CPC ..... *F01P 7/167* (2013.01); *F01P 2025/31* (2013.01); *F01P 2025/62* (2013.01); *F01P 2025/64* (2013.01)

(58) Field of Classification Search
CPC ..... F01P 7/167; F01P 2025/31
IPC ..... F01P 7/167,2025/31
See application file for complete search history.

(56) References Cited

U.S. PATENT DOCUMENTS 4,630,572 A * 12/1986 Evans ..... F01P 3/22 123/41.21
2007/0261648 A1* 11/2007 Reckels ..... F01P 7/167 123/41.12

* cited by examiner

*Primary Examiner* — Kevin Lathers

(57) ABSTRACT

A method is disclosed for improving fuel economy in an internal combustion engine. The method may involve sensing a temperature of an engine block and determining a block thermal energy representing an ability of the block to reject heat. An open loop control scheme may be used together with the block thermal energy to predict if a coolant in the block is about to enter a boiling condition and, when this is about to occur, to open a block valve to permit a flow of coolant through the block. A closed loop control scheme may be used together with the sensed temperature of the block to determine if a coolant boiling condition is about to occur, and to control the block valve to permit a flow of coolant through the block which is just sufficient to prevent the onset of coolant boiling in the block.

19 Claims, 2 Drawing Sheets

SYSTEM AND METHOD FOR ENGINE BLOCK COOLING

CROSS-REFERENCE TO RELATED APPLICATIONS

This application claims the benefit of U.S. Provisional Application No. 62/040,602, filed on Aug. 22, 2014. The disclosure of the above application is incorporated herein by reference in its entirety.

FIELD

The present disclosure generally relates to systems and methods for controlling thermal characteristics of an internal combustion engine, and more specifically to systems and methods for containing thermal energy within an engine block of an internal combustion engine during predetermined operating conditions to enhance fuel efficiency.

BACKGROUND

The background description provided here is for the purpose of generally presenting the context of the disclosure. Work of the presently named co-inventors, to the extent it is described in this background section, as well as aspects of the description that may not otherwise qualify as prior art at the time of filing, are neither expressly nor impliedly admitted as prior art against the present disclosure.

With present day cars and trucks that utilize an internal combustion engine, the engine has an engine block with a block valve. The block valve operates to control the flow of coolant through the block. Routine city driving conditions, however, typically do not require a flow of engine coolant through the engine block. In other words, a stagnant amount of coolant in the engine block is sufficient to help maintain the engine block temperature within an acceptable range and below the temperature at which coolant boiling will start to occur. However, stagnant coolant generally does not provide accurate temperature information when being sensed with a temperature sensor that requires a degree of flow of the coolant over its sensing element. In other words, the stagnant coolant, because it is not flowing, will not enable the temperature sensor to produce accurate temperature readings for the stagnant coolant in the engine block. So if an unpredictable condition was to arise, for example steamer hole plugging, this condition would not be easy to detect from a system that only gauges the engine block temperature with an open loop determination.

It is also highly desirable to maintain the engine block at the highest temperature possible without causing boiling of the coolant within the cooling jackets formed within the engine block. Maintaining the engine block at the highest allowable temperature without producing coolant boiling can enhance fuel efficiency by helping to reduce friction of the moving parts within the engine and maintain the engine oil at an optimum temperature. Therefore, a challenge exists in accurately gauging the engine block temperature during low load operation (e.g., city driving), while still providing the ability to monitor, in a closed loop fashion, thermal conductance and thermal radiation information, and to further control the coolant flow under both low load and high load engine operation while maximizing the thermal energy within the engine block without allowing a coolant boiling condition in the block to arise.

SUMMARY

In one aspect the present disclosure relates to a method for improving fuel economy in an internal combustion engine.

The method may comprise sensing a temperature of an engine block of the internal combustion engine and determining a block thermal energy representing an ability of the engine block to reject heat. An open loop control scheme may be used together with the block thermal energy to predict if a coolant in the engine block is about to enter a boiling condition, and when it is determined that an onset of coolant boiling in the engine block is about to occur, opening a block valve to permit a flow of coolant through the engine block. A closed loop control scheme may be used together with the sensed temperature of the engine block to determine if a coolant boiling condition is about to occur and controlling the block valve to permit a flow of coolant through the engine block which is just sufficient to prevent the onset of coolant boiling in the engine block.

In another aspect the present disclosure relates to a method for improving fuel economy in an internal combustion engine. The method may comprise sensing a temperature of a block of the internal combustion engine and determining a block thermal energy representing an ability of the block to reject heat. An open loop control scheme may be used together with the block thermal energy to predict if a coolant in the block is about to enter a boiling condition, and when it is determined that an onset of coolant boiling in the block is about to occur, causing a flow of coolant through the block. A closed loop control scheme may be simultaneously used together with the sensed temperature of the block to enable a flow of coolant through the block when it is determined that the onset of coolant boiling is about to occur.

In still another aspect the present disclosure relates to a system for maximizing fuel economy in an internal combustion engine. The system may comprise a block coolant temperature sensor which senses a temperature of a coolant in a block of the internal combustion engine. A block valve may be included which is in communication with the block and configured to control a flow of coolant through the block. An engine control module may also be included which is in communication with the block valve and able to control opening and closing of the block valve. The engine control module may further be configured to determine a block thermal energy representing an ability of the block to reject heat. The engine control module may further be configured to use an open loop control scheme together with the block thermal energy to predict if the coolant in the block is about to enter a boiling condition, and when it is determined that an onset of coolant boiling in the block is about to occur, to open the block valve to permit a flow of the coolant through the block. Still further, the engine control module may be configured to use a closed loop control scheme together with the sensed temperature of the block to determine if a coolant boiling condition is about to occur. When coolant boiling is about to occur, the engine control module may control the block valve to permit a flow of the coolant through the block which is just sufficient to prevent the onset of coolant boiling in the block.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
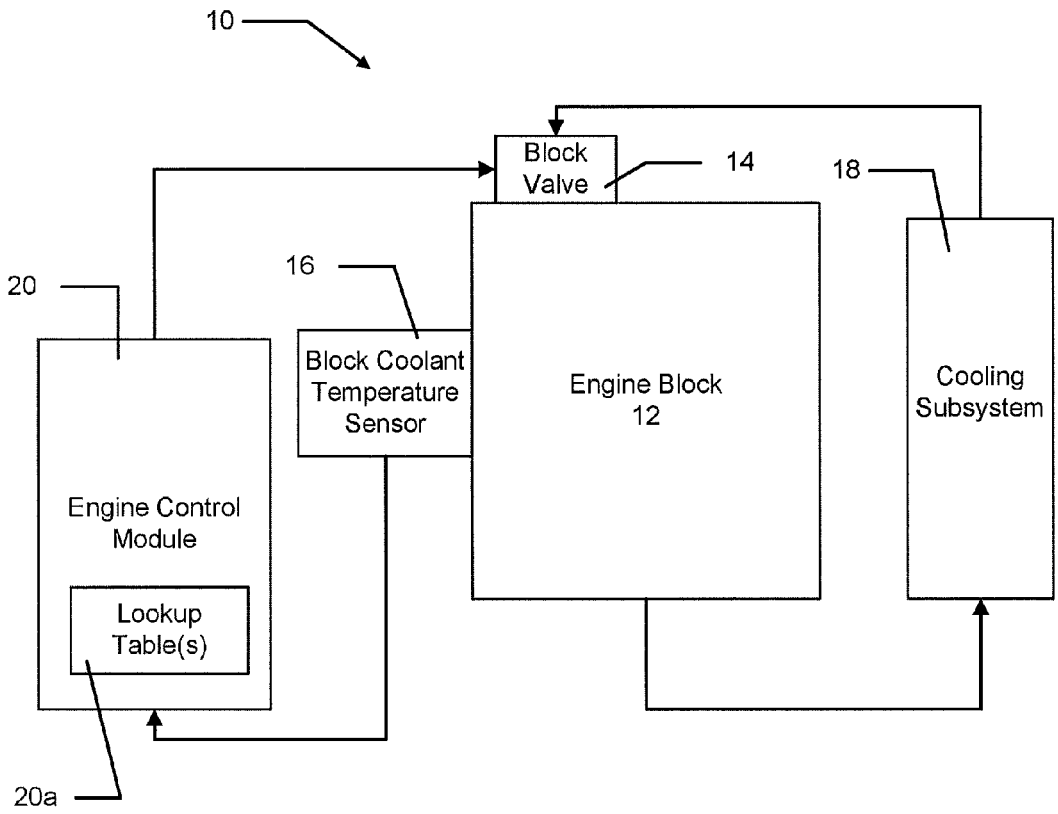
FIG. 1 is a high level block diagram of an internal combustion engine illustrating an engine block in communication with a closed loop cooling subsystem of the engine.

Referring now to FIG. 1, a high level block diagram of an engine system 10 is shown in accordance with one example of the present disclosure. The system in this example may include an engine block 12 (hereinafter simply "block" 12) having a block valve 14 and a block temperature sensor 16 (hereinafter simply "block sensor" 16). A coolant may be circulated through the block 12, in closed loop fashion, to and from a cooling subsystem 18. The cooling subsystem 18 may comprise a radiator, coolant pump, one or more temperature sensors, and assorted flow control valves typically used in modern day internal combustion passenger car and truck engines. However, the teachings of the present disclosure are not necessarily limited to use with just passenger car and truck engines, but may potentially find application in other types of engines which require a flow of coolant there through to help maintain the engine within an optimal operating temperature range. An engine control module 20 having one or more lookup tables 20*a* stored in an associated non-volatile memory (or in an independent memory) receives a temperature signal from the block sensor 16 and may use the temperature signal to control the block valve 14. The engine control module 20 may turn on and off the block valve in accordance with a methodology of the present disclosure to help maintain the block 12 at the highest temperature without causing an onset of coolant boiling in the block. In one example the block valve 14 is a digital block valve which is either fully opened or fully closed.

The present disclosure takes into account that most low load driving conditions (e.g., routine city driving) do not require an actual flow of coolant through the block 12 for the block to be maintained within an acceptable operating temperature. However, it will also be appreciated that during zero flow conditions, typically it is challenging for the block sensor 16 to obtain an accurate temperature reading. The block sensor 16 operates with optimal accuracy with at least some flow occurring across its sensing element. So a significant challenge is accurately gauging the temperature of the stagnant coolant in the block 12 so that the onset of coolant boiling can be avoided.

Another challenge is controlling coolant flow to address conditions such as gasket variation and steamer hole plugging in the block 12. Gasket variation and steamer hole plugging conditions are difficult, if not impossible, to take into account with an open loop system temperature prediction approach, by itself. This is in large part because such conditions are generally difficult and/or impossible to predict. Nevertheless, once they arise, they can raise the temperature within the block 12, and will thus require some degree of coolant flow to ameliorate.

The system 10 and methodology of the present disclosure addresses the above challenges by implementing a simultaneously executed dual control loop control strategy. The dual loop strategy may make use of an open loop control scheme which is provided for rapid temperature response, and a closed loop control scheme which takes advantage of a conductive/radiant temperature input from the block sensor 16 to address more slowly changing sensed temperatures that would not be detectable with just the open control loop. With reference to the flowchart of FIG. 2, this is accomplished by using a methodology 100 which incorporates a dynamometer based, predictive coolant boiling algorithm (hereinafter simply "algorithm"). The algorithm predicts a boiling point of the coolant (i.e., a predetermined temperature threshold) based on a calculated engine heat rejection, while the coolant is stagnant in the block 12. The engine control module opens the block valve 14 to initiate a minimum flow of the coolant through the block 12 to prevent coolant boiling in the block. This open loop control scheme is carried out simultaneously by the engine control module 20 with the closed loop control scheme, which relies on thermal conductance and radiation to influence the block sensor 16. The closed loop control scheme uses an output signal from the block sensor 16 to the engine control module 20 to enable the block valve 14 to be further controlled by the engine control module 20 in the event that gasket or steamer hole plugging occurs, which causes a rise in temperature of the stagnant coolant in the block 12, and which thus requires the block valve 14 to be opened to prevent a coolant boiling condition from arising. Such a condition would be difficult, if not impossible, to predict and respond to by the open loop control scheme.

The algorithm predicts a boiling point of the stagnant coolant in the block 12 by using information obtained which relates to the heat rejection of the block 12 under specific, real time operating conditions. The heat rejection may be estimated based on a plurality of factors such as from real time measurements and/or calculations relating to air-per-cylinder ("APC"), engine torque and/or engine RPM. The lookup table(s) 20*a* thus may hold a plurality of predicted block thermal energy values (i.e., predicted block heat rejection values) based on the APC, engine torque and/or engine RPM, and information relating to a predicted coolant boiling temperature associated with each predicted block thermal energy value. Boiling may be predicted by referencing a basic, coarse temperature range from the block sensor 16. The lookup table(s) 20*a* can be used by the open loop methodology of the present disclosure to predict if coolant boiling is about to begin in the block 12.

Figure 2:
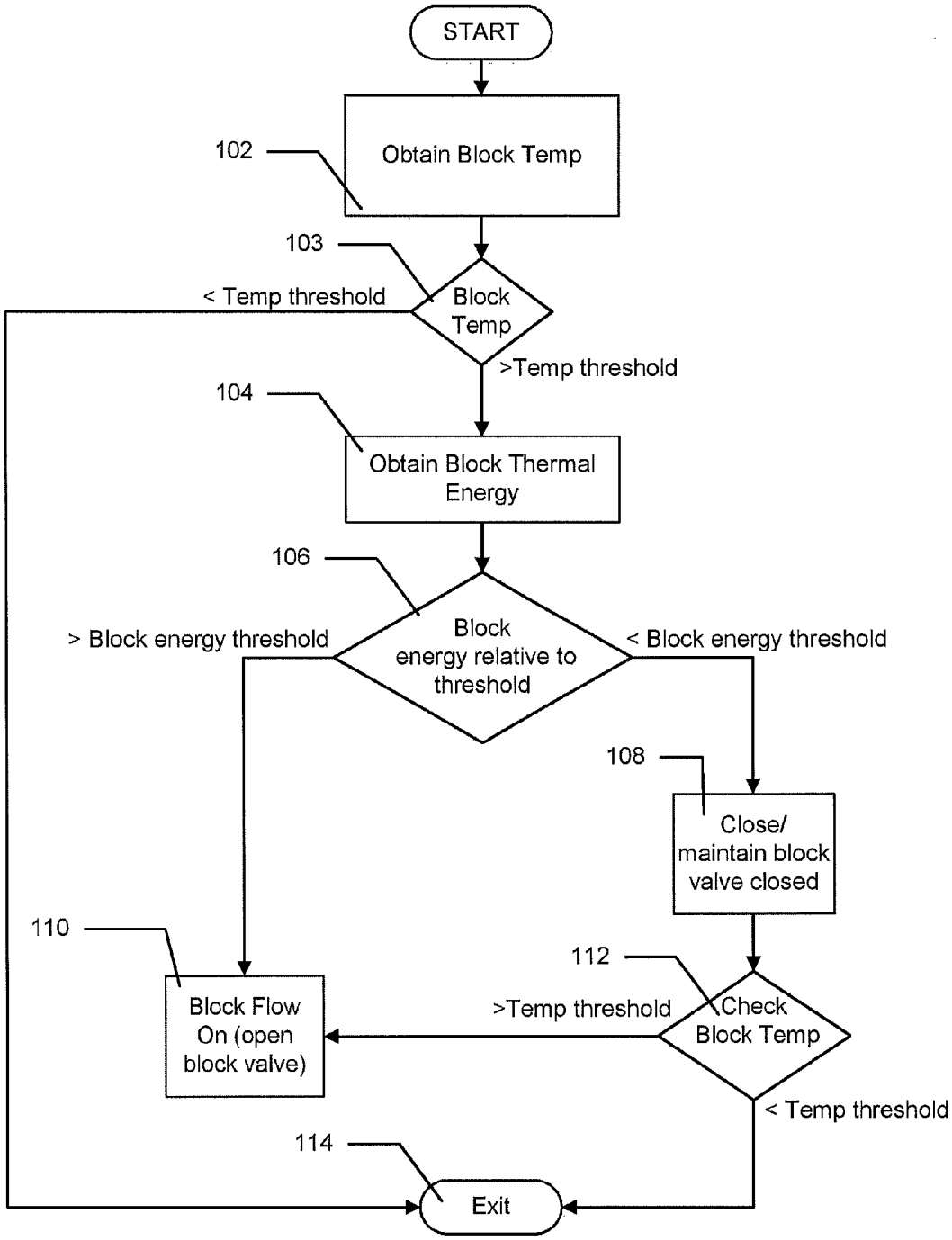
FIG. 2 is a flowchart illustrating one example of operations that may be performed by a method of the present disclosure in implementing a block cooling methodology.

Referring to operation 102 in FIG. 2, the block sensor 16 senses the block temperature in real time. At operation 103, if the sensed block temperature is detected to be below a predetermined maximum temperature threshold, then no action is taken relative to the block valve 14. If the sensed block temperature is determined to be greater than the predetermined temperature threshold, then at operation 104 the block thermal energy is determined (f(APC, torque and/or RPM)). A check is then made at operation 106, using the just-determined block thermal energy and the sensed block temperature in connection with the open loop portion of the methodology (e.g., the lookup table(s) 20*a*), to determine if the block energy (i.e., real time heat rejection ability of the block 12) is above or below a specific block energy threshold. If the block energy is below the specific block energy threshold as checked at operation 106, then the block valve 14 (FIG. 1) is closed (or maintained closed), as indicated at operation 108. This prevents the coolant from flowing through the block 12 and removing heat from the block. This allows the block 12 to at least maintain its present temperature. However, if the check at operation 106 determines that the block thermal energy is greater than the specific block energy threshold, then the block valve 14 is opened, as indicated at operation 110, to allow a flow of coolant through the block 12. This prevents the onset of coolant boiling by allowing a predetermined minimum coolant flow which is just sufficient to prevent the onset of coolant boiling in the block 12.

If the block 12 is closed (or maintained closed) at operation 108, then at operation 112 another check is made, using the closed loop control portion of the methodology, to determine if the sensed block temperature is above or below the predetermined maximum temperature threshold. If the sensed block temperature is above the predetermined maximum temperature threshold, then the block valve 14 is opened at operation 110 to prevent the onset of coolant boiling in the block 12. But if the sensed block temperature is below the predetermined maximum temperature threshold, then the method may end at operation 114. Advantageously, the open loop and closed loop control portions of the above-described methodology run simultaneously with one another.

The operations described in connection with FIG. 2 above, which represent one example of the methodology of the present disclosure, enable the generally lower response time, closed loop circuit to use conduction and radiation to help detect if the coolant in the engine block 12 is at the point where coolant boiling is about to begin. The higher response time open loop circuit may make use of one or more lookup tables that estimate the heat rejection of the block 12 under specific real time operating conditions, and may use the estimated heat rejection of the block in determining whether to open or close the block valve 14. The use of both the open loop control and closed loop control schemes described herein enable the temperature of the block 12 to be maintained during generally low load (i.e., city driving) conditions at a temperature which maximizes the block temperature without allowing the onset of coolant boiling in the block. Put differently, the open and closed loop control methodologies enable a zero coolant flow condition to be maintained in the block 12 without incurring coolant boiling, while maximizing block coolant flow under high load conditions. This is estimated to provide a significant fuel savings of up to, or possibly even greater than, 0.5%, during low load conditions (e.g., city driving typically around 15 mph-30 mph) over a system which permits the flow of coolant through the block 12 at all times.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A method for improving fuel economy in an internal combustion engine, comprising:

sensing a temperature of an engine block of the internal combustion engine;

estimating a block thermal energy representing an ability of the engine block to reject heat;

using an open loop control scheme together with the estimated block thermal energy to predict if a coolant in the engine block is at a temperature where coolant boiling will begin, and before coolant boiling in the engine block occurs, opening a block valve to permit a flow of coolant through the engine block;

using a closed loop control scheme together with the sensed temperature of the engine block to determine when coolant boiling will occur and controlling the block valve to permit a flow of coolant through the engine block which is just sufficient to prevent the onset of coolant boiling in the engine block; and wherein estimating the block thermal energy includes using at least two of:

a real time air per cylinder (APC) determination for the engine block;

a real time determination of torque that the internal combustion engine is outputting; and an engine RPM of the internal combustion engine; and wherein the block thermal energy is represented in a lookup table from which a prediction is made if coolant boiling will occur.

2. The method of claim 1, wherein the estimated block thermal energy is determined based at least in part on a real time air per cylinder (APC) determination for the engine block.

3. The method of claim 1, wherein the estimated block thermal energy is determined based at least in part on a real time determination of torque that the internal combustion engine is outputting.

4. The method of claim 1, wherein the estimated block thermal energy is determined based at least in part on an engine RPM of the internal combustion engine.

5. The method of claim 1, wherein the estimated block thermal energy is determined based on information pertaining to each of:

the real time air per cylinder (APC) determination for the engine block;

the real time determination of torque that the internal combustion engine is outputting; and the engine RPM of the internal combustion engine.

6. The method of claim 1, further comprising using an engine control module to control the block valve.

7. The method of claim 1, wherein using the open loop control scheme comprises using at least one lookup table including block energy values to help make the prediction about whether when coolant boiling will occur.

8. The method of claim 1, wherein the sensing of the temperature of the engine block comprises using a block coolant temperature sensor to sense a temperature of stagnant coolant within the engine block.

9. The method of claim 1, wherein the open loop and closed loop control schemes are used executed simultaneously.

10. A method for improving fuel economy in an internal combustion engine, comprising:

sensing a temperature of a block of the internal combustion engine;

estimating a block thermal energy representing an ability of the block to reject heat;

using an open loop control scheme together with the estimated block thermal energy to predict when a coolant in the block will enter a boiling condition, and before coolant boiling in the block occurs, causing a flow of coolant through the block;

simultaneously using a closed loop control scheme together with the sensed temperature of the block to enable a flow of coolant through the block before coolant boiling is about to occur; and wherein estimating the block thermal energy includes using at least two of:

a real time air per cylinder (APC) determination for the block;

a real time determination of torque that the internal combustion engine is outputting; and an engine RPM of the internal combustion engine; and wherein the block thermal energy is represented in a lookup table from which a prediction is made if coolant boiling will occur.

11. The method of claim 10, wherein the flow of coolant through the block when the open loop control scheme determines that an onset of coolant boiling is about to occur is just sufficient to prevent coolant boiling.

12. The method of claim 10, wherein the flow of coolant through the block when the closed loop control scheme determines when coolant boiling will occur is just sufficient to prevent coolant boiling.

13. The method of claim 10, wherein enabling the flow of coolant through the block with the open loop control scheme comprises using the estimated block thermal energy values in a lookup table accessed by an engine control module, and wherein the estimated block thermal energy values relate to predicted heat rejection values for the block.

14. The method of claim 13, further comprising performing real time sensing of each one of air per cylinder, engine torque and engine RPM, and using the sensed air per cylinder, engine torque and engine RPM in determining a specific predicted block thermal energy value to obtain from a plurality of block thermal energy values in the lookup table.

15. The method of claim 10, wherein the flow of coolant through the block is controlled by an engine control module controlling an opening and a closing of a block valve.

16. The method of claim 10, wherein the sensing of the temperature of the coolant in the block is accomplished using a block coolant temperature sensor.

17. A system for maximizing fuel economy in an internal combustion engine, the system comprising:

a block coolant temperature sensor which senses a temperature of a coolant in a block of the internal combustion engine;

a block valve in communication with the block and configured to control a flow of coolant through the block;

an engine control module in communication with the block valve and able to control opening and closing of the block valve, the engine control module further being configured to:

estimate a block thermal energy representing an ability of the block to reject heat;

use an open loop control scheme together with the estimated block thermal energy to predict when the coolant in the block will begin to boil, and before coolant boiling in the block occurs, to open the block valve to permit a flow of the coolant through the block;

use a closed loop control scheme together with the sensed temperature of the block to determine when coolant boiling condition will occur, and prior to coolant boiling occurring, controlling the block valve to permit a flow of the coolant through the block which is just sufficient to prevent coolant boiling in the block; and wherein estimating the block thermal energy includes using at least two of:

a real time air per cylinder (APC) determination for the engine block;

a real time determination of torque that the internal combustion engine is outputting; and an engine RPM of the internal combustion engine; and wherein the block thermal energy is represented in a lookup table from which a prediction is made about whether if coolant boiling will occur.

18. The system of claim 17, wherein the engine control module executes the open loop control scheme and the closed loop control scheme simultaneously.

19. The system of claim 17, wherein the engine control module obtains real time information relating to each one of air per cylinder, engine torque and engine RPM, for use when accessing the lookup table to help determine, in the open loop control scheme, when coolant boiling will occur.

* * * * *